United States Patent [19]

Barowski et al.

[11] Patent Number: 4,851,641

[45] Date of Patent: Jul. 25, 1989

[54] ELECTRICAL CURLING IRON HAVING A PAIR OF INTERCHANGEABLY USABLE CURLING SECTIONS OF DIFFERENT SIZE AND/OR CONFIGURATION

[75] Inventors: Karlheinz Barowski, Hattersheim; Dieter Liebenthal, Maintal, both of Fed. Rep. of Germany

[73] Assignee: Braun Aktiengesellschaft, Kronberg, Fed. Rep. of Germany

[21] Appl. No.: 63,253

[22] Filed: Jun. 17, 1987

[30] Foreign Application Priority Data

Jun. 21, 1986 [DE] Fed. Rep. of Germany ..... 3620910

[51] Int. Cl.[4] ..... H05B 3/00; A45D 1/04

[52] U.S. Cl. ..... 219/225; 219/222; 219/230; 219/533; 132/229; 132/232

[58] Field of Search ..... 219/221-242, 219/533; 137/7, 9, 11 R, 31 R, 32 R, 33 R, 34 R, 37 R, 37 A

[56] References Cited

U.S. PATENT DOCUMENTS

| | | | |
|---|---|---|---|
| 3,583,409 | 6/1971 | Rios | 132/33 |
| 3,859,497 | 1/1975 | McNair | 219/225 |
| 3,918,465 | 11/1975 | Barradas | 132/37 R |
| 4,533,819 | 8/1985 | Valiulis | 132/37 R |

FOREIGN PATENT DOCUMENTS

| | | |
|---|---|---|
| 3503845 | 8/1985 | Fed. Rep. of Germany . |
| 2513497 | 9/1982 | France . |

*Primary Examiner*—Anthony Bartis

[57] ABSTRACT

An electric curling iron has a handle and unitary curling structure with first and second elongated generally aligned oppositely extending shell sections aligned oppositely extending shell section. Each section is provided with a separate PTC resistance heating element and the two shell sections have different diameters and/or different bristles and/or at least one hair clamping arm. The handle is adapted to be selectively slipped onto either of the two shell sections, whereby at the same time an electrical connection is established between the heating element in the other shell section and an electrical power supply on the handle.

25 Claims, 3 Drawing Sheets

Figures 1, 2A, 2B:
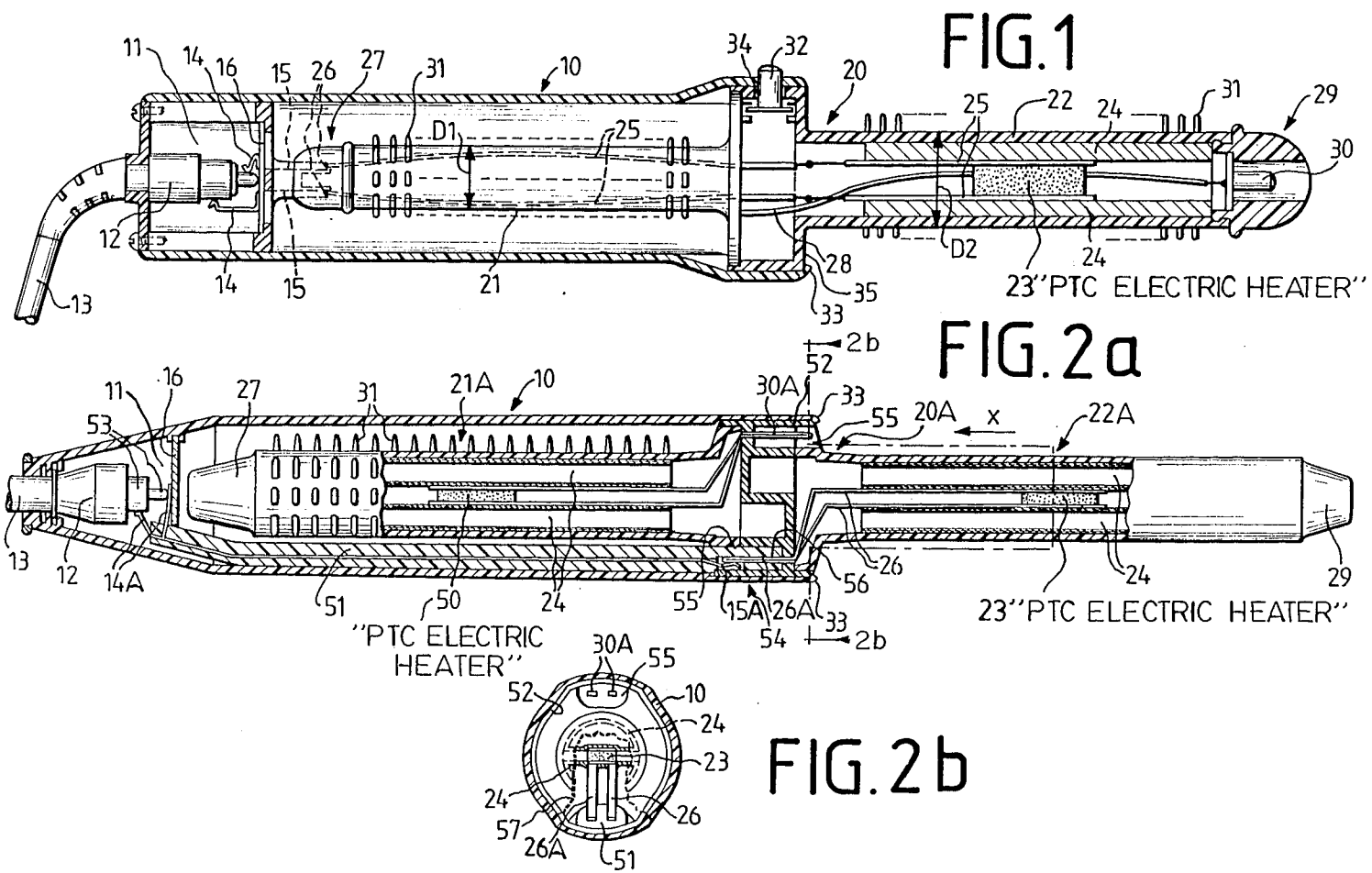

23"PTC ELECTRIC HEATER"
"PTC ELECTRIC HEATER"

ELECTRICAL CURLING IRON HAVING A PAIR OF INTERCHANGEABLY USABLE CURLING SECTIONS OF DIFFERENT SIZE AND/OR CONFIGURATION

This invention relates to an electrically heatable curling iron.

From German published patent application DE-OS No. 3,503,845, an electrically heatable curling iron having a heating unit and a handle is already known, in which then handle includes a connection to the electrical supply, with a disengageable mechanical and electrical connection being provided between the curler and the handle. Curlers of different configurations can be mounted on the handle to meet the different user requirements. Since each curler is equipped with a heating element of its own, each curler can be heated individually through the electrical connection between the handle and the curler. On the other hand, the user has to deal with the inconvenience that any unused curlers which are not mounted on the handle have to be stored in some way, in addition to being quite cumbersome, particularly when taken along on a trip. A further disadvantage for the user is incurred by the relatively high manufacturing and packaging cost of such a curling iron. While the special configuration of the electrical contact members in the handle of the curling iron according to FIG. 1 of this background art may be suitable for devices using rechargeable accumulators, safety reasons forbid its application to curling irons which are at least partly operated on the electrical power supply direct.

Another alternative to adapt curling irons to the different requirements of one or more users is the provision of different curlers adapted to be slid onto the curling iron. A curling iron of this type is known, for example, from U.S. Pat. No. 3,918,465. The general problem in such curling irons is, however, that the heat transfer between the heating element in the curling iron and the different slip-on curlers cannot, as a rule, be optimized for each individual curler, so that the temperature of the curlers does not correspond to the ideal temperatures required for hair styling. In addition, also this variant of adaptable curling irons involves several individual parts to be stored separately and its attendant disadvantages for the user.

Finally, a hair curler of infinitely variable diameter is known from U.S. Pat. No. 3,583,409. while a hair curler of this type may satisfy the individual user requirements, its structure is highly complex, making manufacture expensive. Also, translating this principle to electrically heatable curling irons presents difficulties because it necessitates complex means to accommodate the heating unit in this type of hair curler.

It is, therefore, an object of the present invention to improve upon an electrically operated curling iron in such a manner that it satisfies the individual user requirements while affording simple and safe handling and storage. It is a further object herein to provide a curling iron of compact dimensions and suitable for sale at prices the user can find acceptable.

The two shell sections of the curling structure can be heated separately by at least two heating elements, such that the heating power and the heat transfer can be adapted to the respective configuration of the two ends of the curling structure. Because the handle interior receives part of the curling structure, an extremely compact construction is ensured, eliminating the need for the user to take care of the storage of loose parts. At the same time, the electrical connection connects only that heating element of the curling structure section that projects from the handle to the electrical power supply, supplying it with electrical energy, so that this curling iron is particularly simple and safe to handle.

An advantageous embodiment of an electric curling iron provides a very compact curling iron which, by virtue of the different configuration of the two shell sections, meets the individual user requirements. Because the handle is suitable for both mechanical and electrical connection to the curling structure at either end thereof, simple and safe manipulation and/or storage of the curling structure are realized simultaneously with a compact and low-cost construction. If both sections of the curling structure are provided with bristles, with only the diameters of the curling sections differing, the user has the option to produce curls of different sizes and different tightness. It is particularly advantageous to configure the section of the curling structure having the smaller diameter as a micro-curler for special hair styles as, for example, for short hair. Users preferring the hair clamping version will employ a brushless curling structure having shell sections of different diameters, each being provided with a hair clamping arm. Moreover, this version may include an additional slip-on brush member fitting likewise into the handle when not in use. For users preferring to curl their hair with the brush version or, alternatively, with the hair clamping version, a curling structure having its one section equipped with bristles and its other section with a hair clamping arm is advantageously suitable. In this arrangement, the two sections of the curling structure may have the same or different diameters. If the curling structure section equipped with a hair clamping arm has a diameter smaller than the bristled section, this combination is advantageously suitable in particular for users whose hair is in some areas of their head too short for styling with the bristled section. Reversely, that is, with the bristled section of the curling structure having the smaller diameter, a user who normally styles with curling irons having hair clamping arms will prefer this combination if some of the curls are to be of small diameter and/or are to be wound very tight. Further combination possibilities not expressly mentioned herein are possible and suitable for sale in the market without problems, in accordance with the special requirements of the users.

Another advantage of the curling iron resides in the fact that only a single electric heating element can be provided for heating both ends of the curling, this being accomplished by suitably arranging the heat conducting plates surrounding the heating element. By positioning the heating element provided intermediate the heat conducting plates in a manner suitable for the individual application, a temperature distribution which is matched to the special configuration of the two sections of the curling structure can be realized over the entire length of the curling structure. Arranging the contact terminals of the heating elements in the center area of the two head ends of the curling structure sections, which terminals are adapted to be connected to contact members connected to the power plug in an end area remote from the curling structure in the interior of the handle by joining curling structure and handle together, makes the manipulation of the curling iron very safe since the voltage-carrying parts are not immediately accessible to the user. A guard plate arranged in a cup-shaped recess at either end of the curling structure and displaceable against the force of a spring protects the contact terminals of that section of the curling structure that projects from the handle against contamination. Because heating element of the one section of the curling structure is electrically connected to the contact terminals at the head end of the other section of the curling structure, exposed contact members of the curling are dead, thereby obviating hazards to the user. In a further embodiment of the curling iron of the invention, the electrical contact terminals in the center area of the curling structure are arranged off-center relative to the longitudinal axis and are adapted to be connected to corresponding contact members connected to the power supply and disposed in the end of the handle close to the curling structure. This affords the advantages of a simple assembly and consequently a more economical manufacture, in addition to obviating the provision of contact openings at either end of the curling iron whereby a contamination of the contacts is largely prevented. Particular economy of manufacture and safe manipulation of the curling iron are ensured by configuring the electrical connection between the heating elements and the contact terminals as well as between the contact members and a twist-on connector as link members made of conductive material and by embedding these link members in a separate carrier member. Particularly advantageous for the manipulation of the curling iron of the invention, especially in the embodiment incorporating two hair clamping arms, is the fact that these hair clamping arms can be operated separately by means of a single control element arranged in the center area of the curling iron.

Figure 3:
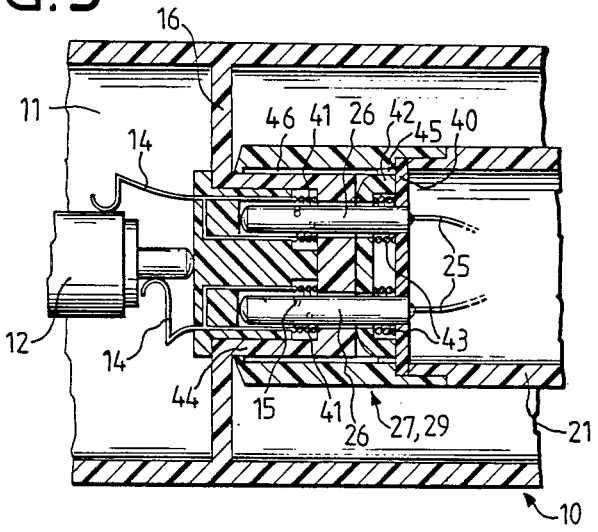
Figure 4A:
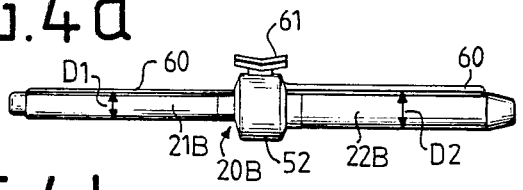
Figure 4B:
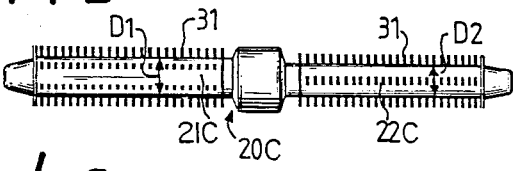
Figure 4C:
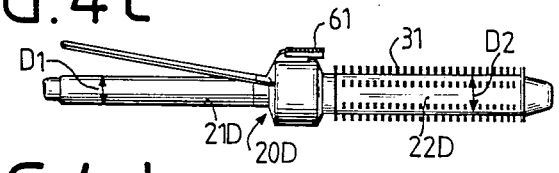
Figure 4D:
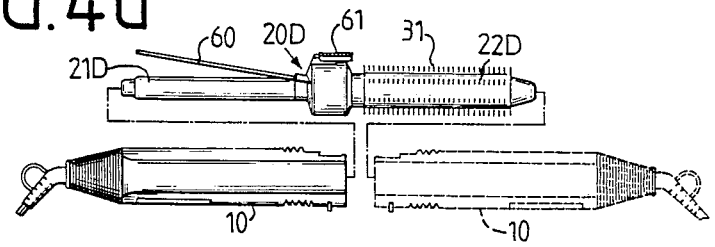
Figure 5C:
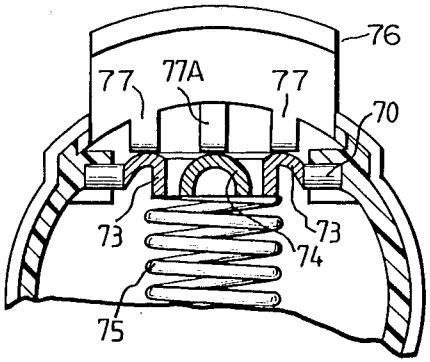
Figure 5B:
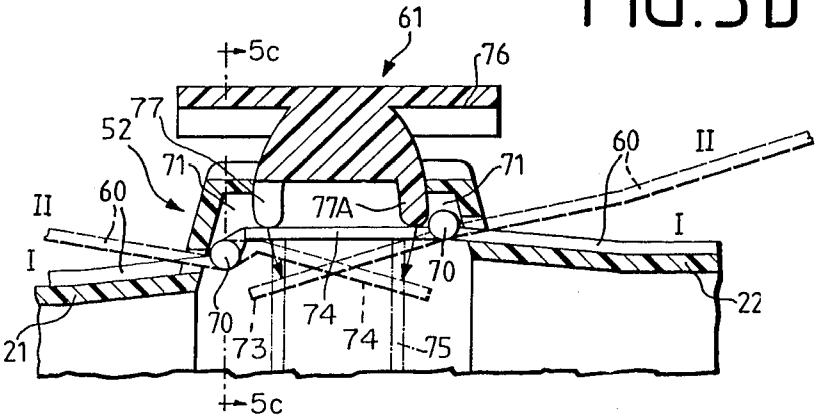
Figure 5A:
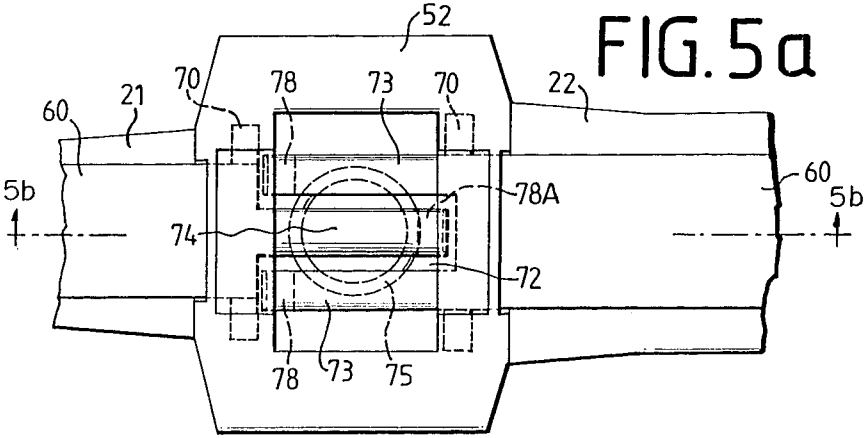

Further advantageous embodiments of the invention will become apparent from the subclaims as well as from the following description of embodiments in conjunction with the accompanying drawings, in which:

FIG. 1 is a longitudinal sectional view of an electrically operated curling iron embodying a first form of the invention;

FIG. 2*a* is a longitudinal sectional view of an electrically operated curling iron embodying a second form of the invention;

FIG. 2*b* is a sectional view of the head end of the curling iron taken along the line 2*b*—2*b* of FIG. 2*a*, showing part of a shell section of the curling iron in broken away condition;

FIG. 3 is a view of another embodiment of the contact arrangement in the head end regions of an electrically operated curling iron of FIG. 1;

FIG. 4*a* is a view of another embodiment of an electrically-operated curling iron in accordance with the invention;

FIG. 4*b* is a view of another embodiment of a curling iron in accordance with the invention;

FIG. 4*c* is a view of still another curling iron in accordance with the invention;

FIG. 4*d* is a schematic representation of manipulation of the curling iron of FIG. 4*c*;

FIG. 5*a* is a top plan view of a control element for hair clamping arms fitted to the curling iron;

FIG. 5*b* is a sectional view taken along the line 4*b*–5*b* of FIG. 5*a*; and FIG. 5*c* is a sectional view taken along the line 5*c*—5*c* of FIG. 5*b*.

Referring now to FIG. 1 of the drawings, there is shown a first embodiment of an electrically operated curling iron in which a handle is assigned reference numeral 10. Arranged in an end area 11 of the handle 10 is a swivel or rotatably connector 12 having its one end connected to an electrical power supply 13 and its other end to contact members 15 via contact springs 14. A supporting plate 16 disposed in the bottom area 11 serves to secure the contact springs 14 and the contact members 15 in position. Reference numeral 20 designates curling structure essentially comprised of a first shell section 21 and a second shell section 22 fixedly connected with each other. The internal structure of the two shell sections 21, 22 of the curling structure 20 being principally identical, it will suffice to explain it only with reference to the second shell section 22. The interior of the shell section 22 accommodates a heating element 23, particularly a PTC resistor, which is sandwiched between heat conducting plates 24 secured in the inner chamber of the second shell section 22 as, for example, by frictional or positive engagement therewith. From the heating element 23 electrical leads 25 extend out of the heat conducting plates 24 through the first shell section 21 up to the head end 27 of the shell section 21 where they are connected to contact terminals 26. The contact members 15 and 26 are mating contacts configured, for example, as a pin-and-socket connector.

In a similar manner, the first shell section n21 receives likewise a heating element disposed intermediate heat conducting plates and having electrical leads 28 extending to contact terminals 30 at the head end 29 of the second shell section 22. In the present embodiment, both shell sections 21, 22 of the curling structure 20 are equipped with bristles 31, their diameters $D_1$, $D_2$ being, however, different. The first shell section 21 of the curling structure is shown as slid into the handle 10, so that the contact members 15 and 26 are electrically connected, causing the heating element 23 in the second shell section 22 to be supplied with electrical energy. In this Figure, two variants which can be used alternatively are represented by way of example as fastening means between the curling structure 20 and the handle 10. Reference numeral 32 identifies a locking button on the curling structure 20 which locks into a bore 34 in the handle 10 as the curling structure 20 is slipped into the handle 10. Alternatively, the handle 10 is provided with latches 33 resiliently engaging a suitably structured portion 35 on the center part of the curling structure 20.

In accordance with the present representation, the second shell section 22 of the curling structure 20 having diameter $D_2$ is being used. If it is desired to use the first shell section 21 having diameter $D_1$, the curling structure 20 merely has to be unlatched from the handle 10 either by pressing the locking button 32 or by imparting a slight pulling motion to the unheated cool head end 29, subsequently pushing the second shell section 22 of the curling structure 20 into the handle 10. Via the contact members 15, 30 and the electrical lead 28 to the heating element, not shown, of the first shell section 21, the latter is heated and ready for use after a short while. As will be set forth in detail in the following, the two shell sections 21, 22 of the curling structure 20 may be of completely different configuations. It is understood that the embodiment of FIG. 1 is merely one of a plurality of variants. The two heating elements have to be dimensioned in accordance with the different embodiments of the two shell sections 21, 22. This ensures that the curling structure 20 is heated to an optimum temperature in any one of its variants. The exposed contact terminals 26, 30 at the respective head end 27, 29 of the respective shell section 21, 22 in use being dead, user safety is ensured during handling.

FIG. 3 shows an advantageous embodiment of the head ends 27, 29 of the curling structure 20. Parts identical with those of FIG. 1 are assigned like reference numerals. The curling structure 20 possesses at its head end 27, a cup-shpaed recess closed by a bottom plate 40. Secured to the bottom plate 40 are the two contact terminals 26 configured as pins from which the electrical leads 25 extend to the heating element 23 situated in the other shell section 22. The contact terminals 26 engage into contact members 15 configured as sockets mounted on the bottom of the supporting plate 16 of the handle 10. From spring elements 41 arranged in the sockets and establishing an electrical connection to the contact terminals 26 of the curling structure 20, contact springs 14 extend to the swivel connector 12. The cup-shaped recess accommodates a member formed as a cover 42 and slidably mounted on the contact terminals 26, the cover including two openings for passage of the contact terminals 26 therethrough. With the curling structure 20 detached from the handle 10, the cover 42 will be slid over the contact terminals 26 by means of at least one spring 43, causing the contact terminals to disappear in the cup-shaped recess under the cover 42. The cover 42 will be secured in this position by means of a retaining or guiding arrangement preventing it from slipping out of the cup-shaped recess. Thus, for example, tabs 45 are to be provided on the cover for engagement into grooves 46 formed in the side wall area of the cupshaped recess. The provision of such a cover for the contact terminals 26 of that shell section of the curling structure 20 that extends out of the handle 10 when in use protects the contacts against contamination in a particularly advantageous manner, thereby ensuring a perfect electrical connection between the contact terminals 26, 30 and the contact members 15 even after prolonged use of the curling structure. As the curling iron 20 is inserted into the handle 10, the socket contacts 15 on the supporting plate will displace the cover in the direction of the bottom plate 40 against the force of the spring or springs 43, thereby exposing the contact terminals 26. For this purpose, a portion 44 is suitably structured so as to receive the contact members 15 or the spring elements 41, the portion having an outside diameter at least slightly smaller than the inside diameter of the cup-shaped recess at the head end 27, 29 of the curling structure 20.

FIGS. 2*a* and 2*b* show a further embodiment of an electric curling iron which differs from the embodiment of FIG. 1 particularly by the arrangement of the contacts. Again, like parts are identified by like reference numerals. For reasons of representation, the second shell section 22 of the curling structure 20 is shown in slightly shortened form. While being identical in diameter, the two shell sections 21A, 22A in this Figure differ in that the first shell section 21A is equipped with bristles 31 whereas the second shell section 22A includes a hair clamping arm not shown in the drawing. The contact springs 14A extend as unitary members from contact surfaces 53 of the swivel connector 12 into a rim area 54 at the open end of the handle 10. The springs are carried and insulated in a carrier member 51 secured to the inner wall of the handle 10. In the rim areas 54 of the handle 10, the contact springs 14A are slightly angular, acting as resilient contact members 15. The contact terminals 26 and 30 extending from the heating element 23 and a heating element 50, respectively, of the first shell section are received in recesses 55 in a coupling member 52 connecting the two shell sections 21A, 22A of the curling iron 20 together. The outer contours of the recesses 55 are shaped to conform to the cross section of the carrier member 51 to be able to receive the latter. The contact terminals 26A, 30A extend as unitary members to their respective heating elements 23, 50, being sandwiched between the heating elements and the heat conducting plates 24. IF the first shell section 21 of the curling structure 20 is inserted into the handle 10 as shown, for example, in FIG. 2A, the contact terminals 26 which are connected to the heating element 23 will enter the carrier member 51 through a bore or opening 56 and slip under the angular resilient contact members 15, thereby establishing an electrically conducting connection between the heating element 23 and the swivel connector 12. The contact terminals 26A, 30A are double-layered in the area of the recesses 55 for reinforcement.

If it is desired to use the first shell section 21A of the curling structure 20, the curling structure 20 has to be pulled out of the handle 10 at the head end 29 and the second shell section 22A has to be pushed into the handle 10, whereby a connection is established between the contact terminals 30 and the contact members 15 of the carrier member 51. According to the present embodiment, therefore, the shell section 21A of the curling structure 20 equipped with the bristles 31 can then be used following a short heat-up time. FIG. 2*b* shows an end elevation of the curling structure 20 and the handle 10, viewed in the direction of arrow X indicated in FIG. 2*a*. The dashed line 57 denotes a breaking away of the second shell section 22A of the curling structure 20, so that also the carrier member 51 can be seen in addition to the heating element 23 and the contact terminals 26A. Indicated by dashed lines are also the heat conducting plates 24 surrounding the heating element 23.

This embodiment is particularly advantageous because it permits the entire arrangement to be assembled with relative ease, thereby reducing the cost of manufacture of the curling iron, and also because it omits the need for contact openings in the head ends 29, 27 which eliminates the risk of contamination to the largest possible extent.

FIGS. 4*a*–4*d* show various basic variants of the curling structure 20A. In FIG. 4*a*, the two shell sections 21B, 22B of the curling structure 20B are of different diameters $D_1$, $D_2$, either shell section 21B, 22B being provided with a hair clamping arm 60 both of which are operable by a single control element 61 mounted on the coupling member 52. This embodiment is preferred in particular by users conventionally employing curling irons with hair clamping arms. This variant enables the user to form curls of different diameter or different tightness. The shell section 21B having the smaller diameter $D_1$ may be advantageously configured as a micro-curler, this configuration requiring the heating element to be dimensioned for a very short heat-up time. In addition, some applications make it desirable to provide slip-on brushes for the curling structure 20B of FIG. 4*a*. By these means, the curling structure 20B is tailored to the individual user requirement to an even greater degree. The slip-on brushes not shown in the drawing are dimensioned in respect of the aperture width of the handle 10 in such a manner that they can be equally received in the handle 10 in their slipped-on condition. Because these attachments require no additional storage space when the curling iron is not in use, the advantages such as compactness, ease of transport and manipulation are fully maintained.

FIG. 4*b* shows likewise a curling structure 20C in which the two shell sections 21C, 22C are of different diameters $D_1$, $D_2$. Both shell sections 21C, 22C are, however, equipped with bristles 31. This embodiment is employed by users normally preferring a bristled curling iron. Curls of different diameters and/or different tightness can be set using a single curling iron. Also, configuring one of the shell sections 21C, 22C as a microcurler necessarily involving an appropriate dimensioning of the associated heating element constitutes another, under the circumstances advantageous, variant.

Finally, FIG. 4*c* shows a curling structure 20D in which the first shell section 21D is of reduced diameter $D_1$ and includes a hair clamping arm 60 with the associated control element 61. By contrast, the second shell section 22D having the larger diameter $D_2$ is equipped with bristles 31. This configuration is intended for users customarily working with a bristled curling iron of the conventional type. In addition, the first shell section 21D permits also the styling of hair which is at least in part too short for conventional curling brush versions. Still further, the use of a brush attachment adapted to be slipped onto the first shell section 21D affords further possibilities of meeting the user's specific requirements. For users conventionally working with curling irons having hair clamping arms, an embodiment is to be provided in which the shell section having the reduced diameter is equipped with bristles 31 whilst the shell section with the larger diameter is provided with a hair clamping arm 60.

For special applications an embodiment is advantageous in which both shell sections 21, 22 have the same diameter yet different bristles 31, or a combination of hair clamping arm 60 and bristles 31.

FIG. 4*d* is a schematic representation of the manipulation of the curling iron of the invention. The handle 10 is adapted to be slipped onto the first shell section 21D of the curling structure 20D so that the second shell section 22D which in the present embodiment is equipped with bristles 21 is turned to use. The representation shown in dashed lines depicts the same handle 10 in a second position in which it is slipped onto the second shell section 22D of the curling structure 20D. In this position, the first shell section 21D including the hair clamping arm 60 will be put to use.

Aside from the embodiments identified in which invariably each individual shell section 21, 22 is assigned a heating element 23, 50 to provide optimum temperature conditions, there are at least some applications in which the use of a single heating element for both shell sections 21, 22 jointly has proved useful. The heat conducting plates 24 extend through the entire length of the curling structure 20, including also the area of the coupling member 52. In this embodiment, the temperatures of the two shell sections 21, 22 can be adjusted by a suitable, for example, asymmetrical, position of the single heating element in the curling structure 20. Moreover, such an embodiment requires the provision of additional heat insulating means in the inner area of the handle 10. By this variant, the manufacturing cost of the curling iron described can be reduced still further.

FIGS. 5*a*–5*c* show a particularly advantageous embodiment of the control element 61 for operating in particular two hair clamping arms 60 of a curling occurrence 20. In a longitudinal section of the curling occurrence 20 of FIG. 4*a*, the two shell sections 21, 22 having different diameters and being interconnected by the coupling member 52 are indicated schematically. The two hair clamping arms 60 are pivotally mounted on pivots 70 in the edge areas 71 of the coupling member. In the area intermediate the pivots 70, the one hair clamping arm 60 is recessed as at 72 so that two finger-type extensions 73 extend along the two longitudinal sides of the hair clamping arm 60. The other hair clamping arm 60 diminishes abruptly on either side in the area intermediate the two pivots 70, such that an extension 74 is between the two finger-type extensions 73. Seated under these extensions 73, 74, that is, in the interior of the curling occurrence 20, is a resilient element 75, in particular a spiral spring or the like, urging the hair clamping arms 60 in their rest positions I against the two shell sections 21, 22 of the curling occurrence 20. On the side of the extensions 73, 74 remote from the resilient element is a control button 76 having in the edge areas of its underside opposite tabs 77, 77A. Two tabs 77 are arranged on the side of the control button 76 pointing to the shell section 21, which tabs register with contact surfaces 78 at the ends of the two finger-type extensions 73 of the one hair clamping arm 60. On the side of the control button 76 opposite these two tabs 77 is another tab 77A which registers with the contact surface 78A at the end of the extension 74 of the other hair clamping arm 60. Operation of the control button 76 which is adapted to be tipped towards either head end 27, 29 of the curling structure 20 causes in the one operating position the two tabs 77 registering with the extensions 73 to act upon the hair clamping arm 60 operatively associated with the second shell section 22, to the effect that this arm is lifted clear of the second shell section 22 in opposition to the spring force of the resilient element 75. Tipping the control button 76 in the other direction causes the hair clamping arm 60 operatively associated with the first shell section 21 to be lifted clear of the first shell section 21, this movement being effected by the application of force of the one tab 77A to the extension 74.

Compressing the resilient element 75 when manipulating the control button 76 in the one or the other of its two operating positions may produce a minor clearance of the other hair clamping arm 60 which is supposed to remain in its position of rest, so that this arm may tend to unseat itself a small amount from its shell section. Such movement of the hair clamping arm supposed to be at rest on operation of the other hair clamping arm is counteracted by the provision of suitably structured portions in the interior of the handle 10 to secure the hair clamping arm 60 of the shell section 21, 22 inserted into the handle 10 to its associated shell section. Since the curling structure 20 is operable only with the handle 10 in slipped-on position, the hair clamping arm 60 to be at rest is reliably prevented from unseating itself even a small amount when the other hair clamping arm is being used. As will be seen from FIG. 5c, the extensions 73, 74 have an approximately U-shaped profile ensuring sufficient rigidity of the lever arms of the hair clamping arms 60. Configuring the control element 61 as a single control button 76 for operating in particular two hair clamping arms 60 of the curling structure 20 provides great ease of operation and a very compact construction contributing advantageously to effectiveness of manipulation of the curling iron.

It is to be understood that further improvements of this particular embodiment and the other embodiments of a twin curler are part of the disclosure and do not depart from the scope of the invention.

We claim:

1. In an electrically heatable curling iron comprising elongated curling structure including an electrical heating unit, a handle adapted to be connected to an electrical supply and having disengageable mechanical and electrical connecting means provided between said curling structure and said handle the improvement wherein:

(a) said curling structure comprises a pair of shell sections extending in opposite directions and each is adapted to be heated by a separate electrical heating element associated with respective ones of said pair of shell sections;

(b) said handle is adapted to be slid on and secured to either end of said curling structure, such that said handle receives and accommodates in its interior one of said shell sections of said curling structure while the other shell section of said curling structure extends out of said handle for use; and (c) the heating element of the projecting shell section is adapted to be electrically connected to the power supply by said disengageable electrical connecting means on such curling structure and handle.

2. In a curling iron as claimed in claim 1, the improvement wherein said two shell sections of said curling structure are of different diameters ($D_1$, $D_2$).

3. In a curling iron as claimed in claim, the improvement wherein one shell section of said curling structure is equipped with bristles.

4. In a curling iron as claimed in claim 1, the improvement wherein both shell sections of said curling structure are equipped with bristles.

5. In a curling iron as claimed in claim 1, the improvement wherein one shell section of said curling structure has a hair clamping arm.

6. In a curling iron as claimed in claim 1, the improvement wherein both shell sections of said curling structure have a hair clamping arm.

7. In a curling iron as claimed in claim 6, the improvement wherein said hair clamping arms are adapted to be operated separately by means of a single control element arranged in a center area of said curling structure.

8. In a curling iron as claimed in claim 7, the improvement wherein said first and second hair clamping arms each includes a pivotal mounting, and said arms each include an extension in the area intermediate said pivotal mountings, with one extension engaging a recess in the other extension, said extensions being exposed to the action of a resilient element.

9. In a curling iron as claimed in claim 8 and further including a control button of said control element, which button is adapted to be tipped to two sides, and has on its side close to said extensions tabs which register with contact surfaces of said extensions.

10. In a curling iron as claimed in claim 7, the improvement wherein an inner space of said handle is provided with suitably structured portions preventing the hair clamping arm of the shell section of said curling structure inserted into the interior of the handle from unseating itself.

11. In a curling iron as claimed in claim 1, the improvement wherein said electrical connecting means includes electrical contact terminals associated with said heating elements and arranged in the center area of the head end of each of said shell sections and adapted to be connected to corresponding contact members connected to power supply wires in an end area in the interior of said handle by joining said curling structure and said handle together.

12. In a curling iron as claimed in claim 11, the improvement wherein said contact terminals of said heating elements are each adapted to be covered by means of a cover displaceable against a spring force with the connection between said curling structure and said handle disengaged.

13. In a curling iron as claimed in claim 13, the improvement wherein said cover (42) is displaceably mounted on said contact terminals in a cup-shaped recess at the head end of each of said shell sections of said curling structure.

14. In a curling iron as claimed in claim 11, the improvement wherein the heating element of one shell section is electrically connected to contact terminals at the head end of the other shell section of said curling structure.

15. In a curling iron as claimed in claim 11, the improvement wherein said handle includes swivel connector structure arranged between the power supply wires and said disengageable electrical connecting means.

16. In a curling iron as claimed in claim 15, the improvement wherein an electrical connection between said heating elements and said contact terminals is formed of unitary link members made of conductive material.

17. In a curling iron as claimed in claim 16, the improvement wherein said unitary link members are carried in a separate carrier member.

18. In a curling iron as claimed in claim 15, the improvement wherein said contact spring structure rests against contact surfaces of said swivel connector structure, and the connection between said contact spring structure and the contact members as well as the contact members are formed of unitary link members of conductive material.

19. In a curling iron as claimed in claim 1, the improvement wherein said electrical connecting means includes electrical contact terminals associated with said heating elements and located in the center area of the curling structure with said terminals arranged off-center relative to its longitudinal axis and adapted to be connected to corresponding contact members connected to power supply wires and arranged in a rim area of said handle.

20. In a curling curling iron as claimed in claim 19, the improvement wherein the center area of said curling structure includes a coupling member having two recesses in which said contact terminals are disposed.

21. In an electrically heatable curling iron including elongated curling structure having an electric heating unit, and having a handle adapted to be connected to an electrical supply, with disengageable mechanical and electrical connecting means being provided between the curling structure and the handle, the improvement wherein said curling structure is configured as a twin curler, said curling structure including a first shell section and an oppositely extending second shell section, said first shell section differing in its construction from said second shell section, and that said handle is adapted to be mechanically and electrically connected to said curling structure at either end thereof such that one of said shell sections is received and accommodated in said handle, and the other shell section extends from said handle for use and said heating unit is adapted to be electrically connected to the power supply by said electrical connecting means.

22. An electrically heatable curling iron comprising a unitary curling structure having two elongated shell sections disposed end to end in generally aligned oppositely extending relation, an electrical heating element structure associated with said shell sections and connecting structure associated with said shell sections for electrically connecting said heating element structure to a power supply, and handle structure including structure defining a receptacle for selectively receiving and substantially enclosing either one of said shell sections with the other shell section extending outwardly from said handle structure, and electrical connecting structure carried by said handle structure for detachable connection with said electrical connecting structure of said curling structure for energizing the heating element structure to heat the shell section extending outwardly from said handle structure.

23. The curling iron of claim 22 wherein said electrical connecting structure of said curling structure is at a head end of each said shell section of said curling structure and each said electrical connecting structure is adapted to be detachably connected to said connecting structure carried by said handle structure adjacent an interior base region of said receptacle defining structure.

24. The curling iron of claim 22 wherein said shell sections are disposed along a longitudinal axis and said electrical connecting structure of said curling structure is arranged between said shell sections, and said connecting structure of said handle structure is disposed in rim area of said receptacle defining structure.

25. The curling iron of claim 24 wherein said electrical connecting structure of said curling structure is arranged off-axis relative to said longitudinal axis of said curling structure.

* * * * *

UNITED STATES PATENT AND TRADEMARK OFFICE

CERTIFICATE OF CORRECTION

PATENT NO. : 4,851,641

DATED : July 25, 1989

INVENTOR(S) : Barowski, et al.

It is certified that error appears in the above-identified patent and that said Letters Patent is hereby corrected as shown below:

In the Abstract, line 3 delete "aligned oppositely extending shell sections".

Col. 1, line 12, "then" should be --the--;
line 49, "while" should be --While--.
Col. 2, line 52 after "curling" insert --structure--.

line 63, "4b" should be --5b--.
Col. 4, line 3, "rotatably" should be --rotatable--.
line 27, "n21" should be --21--.
Col. 5, line 8, "shpaed" should be --shaped--;
line 32, "cupshaped" should be --cup-shaped--;
line 40, "iron" should be --structure--;
line 66, "areas" should be --area--.
Col. 6, line 10, "IF" should be --If--;
line 47, "20A" should be --20B--.
Col. 7, lines 11-12, "microcurler" should be --micro-curler--.
Claim 3, col. 9, line 32, after "claim" insert --1--.

Claim 13, col. 10, line 13, "13" should be --12--.
Claim 20, col. 10, line 51, delete "curling" before "curling".

Signed and Sealed this

Sixth Day of November, 1990

*Attest:*

HARRY F. MANBECK, JR.

*Attesting Officer*

*Commissioner of Patents and Trademarks*